US007857043B2

(12) United States Patent
Ali-zada et al.

(10) Patent No.: US 7,857,043 B2
(45) Date of Patent: Dec. 28, 2010

(54) POLISHED ROD ROTATOR

(76) Inventors: Vagif Ali-zada, 14539 78th Avenue, Surrey, BC (CA) V3S 9C5; Narguiz Ali-zade, 14539 78th Avenue, Surrey, BC (CA) V3S 9C5

( * ) Notice: Subject to any disclaimer, the term of this patent is extended or adjusted under 35 U.S.C. 154(b) by 478 days.

(21) Appl. No.: 11/500,746

(22) Filed: Aug. 9, 2006

(65) Prior Publication Data

US 2008/0035325 A1 Feb. 14, 2008

(51) Int. Cl.
*E21B 19/00* (2006.01)

(52) U.S. Cl. ..... 166/78.1

(58) Field of Classification Search ..... 166/68.5, 166/78.1, 241.2, 241.3, 241.4; 74/21, 24
See application file for complete search history.

(56) References Cited

U.S. PATENT DOCUMENTS 1,749,722 A * 3/1930 Stevens ..... 74/21
2,318,315 A * 5/1943 Johnston ..... 74/24
2,471,198 A * 5/1949 Cormany ..... 166/78.1
2,603,098 A * 7/1952 Cremeens ..... 74/142
2,660,893 A * 12/1953 Paterson ..... 74/21

* cited by examiner

*Primary Examiner*—David J Bagnell
*Assistant Examiner*—David Andrews

(57) ABSTRACT

A polished rod rotator uses a new method and mechanism to rotate a string of sucker rods relative to a string of oil well tubing to high degrees of rotational angle and achieve large rotator torque. The activation and resulting rotation torque is achieved through axial impact directly by the weight of the sucker rod string at the end of the downward movement of the pumping equipment. The rotator is a two-part assembly, one part is attached to a well-head stuffing box and the other is attached to a polished rod, having a hollow body with spiral slots with rollers. With the downward movement of a beam, the two parts dock through their docking surfaces, while the weight of sucker rods forces the rotator to move down using rollers in spiral slots rotating the polished rod along with the sucker rods until the beam's movement is complete. With the upward movement of the beam, the parts undock rod rotator is static waiting for the completion of pumping cycle.

2 Claims, 4 Drawing Sheets

POLISHED ROD ROTATOR

REFERENCES CITED

| U.S. Patent Documents | | | |
|---|---|---|---|
| 2.178.700 | November, 1939 | Penick et al. | 166/78 |
| 2.294.061 | August, 1942 | Williamson | |
| 2.471.198 | May, 1949 | Cormany | 166/78 |
| 2.595.434 | May, 1952 | Williams | |
| 2.599.039 | June, 1952 | Baker | |
| 2.630.181 | March, 1953 | Solum | |
| 4.716.961 | January, 1988 | Makins, Jr. et al | 166/68 |
| 4.844.171 | July, 1989 | Russel, Jr. | 166/78 |
| 4.993.276 | February, 1991 | Edwards | 166/78 |
| 5.427.178 | June, 1995 | Bland | 166/78.1 |

BACKGROUND OF THE INVENTION

The present invention is in the field of wellhead equipment and is intended for use in oil wells, where extraction is carried out by using pumping equipment with reciprocating sucker rods. This invention is used to rotate a string of sucker rods during the operation of pumping equipment.

The overwhelming majority of oil wells have either intended or unintended deviation from the vertical axis. Rod rotators and tubing rotators are used in order to decrease the wear of strings of oil well tubings and sucker rods, prevent unwanted unscrewing of sucker rods and reduce the deposit of wax and paraffin on the surfaces of tubings and sucker rods.

Rod rotators such as Hercules by R&M Energy Systems or RODEC are firmly attached to the upper part of polished rod through a central hole in the body. There is a ratchet-type converting mechanism (worm shaft) inside the body. This mechanism is activated using an actuator lever. One end of this lever sits on an intake shaft and is outside of the body, and the other end is connected with the front arm of walking beam of pump jack through actuator cable.

This type of a device forms a 4-member linkwork. The first member is an upper part of polished rod that is suspended on the head of a walking beam using a cable. The second element is a part of the front arm of the walking beam. The third part is the flexible actuator cable, and the fourth element is an actuator lever of rod rotator. The rod rotator becomes a hinge, which converts limited angular movement of the members into a rotating movement, and thus, turns polished rod along with a string of sucker rods in a perpendicular plain to a certain angle. It is this angle of the turn of string of sucker rods that is supposed to change the point of contact between the tubing and sucker rods, to avoid the contact of tubing with sucker rods in the same spot and thus increase wear resistance of both wearing parts.

This method of using rod rotators in pumping equipment is less effective for several reasons. Below are some of these reasons.

- The degree of the rotation angle of polished rod is very small and within the elasticity range of the sucker rod string-cable suspension. The gear ratio of rod rotators is within 30-40 degrees. At an actuator lever's effective rotation angle of 15-20 degrees, the rotation angle of polished rod can have a maximum value of 0.1-0.4 degrees.
- The maximum tension of actuator cable can be achieved only at the end of the walking beam's movement down. This means that the force necessary to rotate the polished rod appears only after the movement is either completed or coming to an end.
- The force applied to the actuator lever of rod rotator is located at some distance from the axis of polished rod. This leads to the moment of force that constantly pulls polished rod in the same direction. Consequently, this situation results in the accelerated wear of sealing packers of wellhead stuffing box that seal the head of the well and thus, necessitate frequent replacement of sealing packers.

Hence, the aforementioned rod rotators can achieve only one objective out of three that we mentioned above. Namely, 1. They can achieve the objective of preventing unwanted unscrewing of string of sucker rods
2. They do not achieve the objective of increasing wear resistance of wearing equipment
3. They do not achieve the objective of decreasing the deposits of wax and paraffin on the walls of tubing and sucker rods.

It was the result of the lack of effective engineering solutions to achieve the abovementioned objectives for rod rotators that led the main engineering thoughts on tube rotators to focus on attaining the same objectives.

The known US patents on tubing rotators cited in the References have one common design basis. It is activation of tubing rotator from walking beam with flexible cables and further conversion of angular movement into rotation in a perpendicular plane. In other words, this is exactly the same as the mode of usage and engineering approach to rod rotators with minute differences.

Tubing rotators are used to achieve the last two objectives mentioned above. However, this approach comes with the following shortcomings:

- Correlation of the masses of sucker rods and tubing is within 1:4 and 1:5. This fact explains the inevitable increase in tubing rotators' mass. Energy spent by tubing rotators in order to achieve necessary rotation torques of tubing strings is substantial and is 5 to 10 times higher than that of rod rotators.
- Length of time needed to install a tubing rotator at a wellhead is approximately several hours, while it takes only an hour to install a rod rotator.
- As a tubing rotator's mass considerably exceeds that of a rod rotator, the fabrication, transportation, service and other costs of two parts are quite different.

We have to note that all known forms of tubing rotators work according to the same principle as rod rotators: they are all activated by an arm of the walking beam of pumping equipment. The only difference is that the installation of tubing rotators is done on wellhead flange of casing string for all types of tubing rotators. This leads to the shift of the kinematical scheme from 4 members in rod rotators to 3 members in tubing rotators. But the activation method remains intact—activation from the arm of the walking beam.

The present invention solves this problem in a radically different manner. In other words, the invention does not involve the activation of rod rotator using arm of walking beam of pumping equipment.

The present invention solves the problem in such a way that a string of sucker rods activates rod rotator. This allows obtaining larger results from the rotation torque of the string of sucker rods as well as larger rotation angles in tens of degrees that are not possible in existing technologies of rod rotators. We have to note that known tubing rotators do not have this type of rotation angle either.

The present invention achieves the three objectives mentioned above more effectively and comprehensively.

BRIEF SUMMARY OF THE INVENTION

The present rod rotator invention proposes a new method and mechanism to rotate a string of sucker rods in relation to a string of oil well tubing to high degrees of rotation angle and large rotation torque.

The activation and resulting rotation torque is achieved through axial impact directly by the weight of sucker rod string at the end of the downward move of the pumping equipment at some distance from the lowest dead center, for instance, 40-100 mm.

The present invention consists of two main parts that dock through joined surfaces and is installed with solid attachment of one of the parts to the uppermost part of well bore, usually at wellhead stuffing box. The lower part of the rod rotator that is usually solidly attached can also be an integral part of wellhead stuffing box.

The second main part of the rod rotator is solidly attached to the polished rod.

The docking surfaces of both parts can be fabricated in any shape that ensures good docking. Below are only two examples of many potential embodiments of such surfaces.

Example of embodiment 1: Two self-docking cones that dock with each other at a 5 to 12 degree angle or;

Example of embodiment 2: Both docking surfaces have toothed hatch where the teeth from one surface get inserted between teeth of the opposite surface. There are other embodiments of the surfaces of docking parts.

One of the parts of the rod rotator has a hollow cylindrical body with 2 or 3 spiral slots. A rotator is installed in the inner cavity/chamber of the cylindrical body with a centrally located hole for polished rod. The rotator has horizontal holes that house axes with rollers. These rollers are also placed in spiral slots of the cylindrical body and are able to move up and down in these slots.

The body has a base with a central hole and a spring that is installed between the bottom and rotator.

The rotator has toothed cotters in its central hole, which are clamped, between polished rod and a part of the rotator opposite the cotters by a bolted plate.

The body is covered with an external cover whose lower part butts against the external thrust land of the body, and the upper part is covered with a cap screw In any specific embodiment both main parts of the rod rotator can be placed one above the other and vice versa. That is the part that has the hollow body can be placed above or below the other part.

DETAILED DESCRIPTION OF INVENTION (PREFERRED EMBODIMENT)

Figure 1:
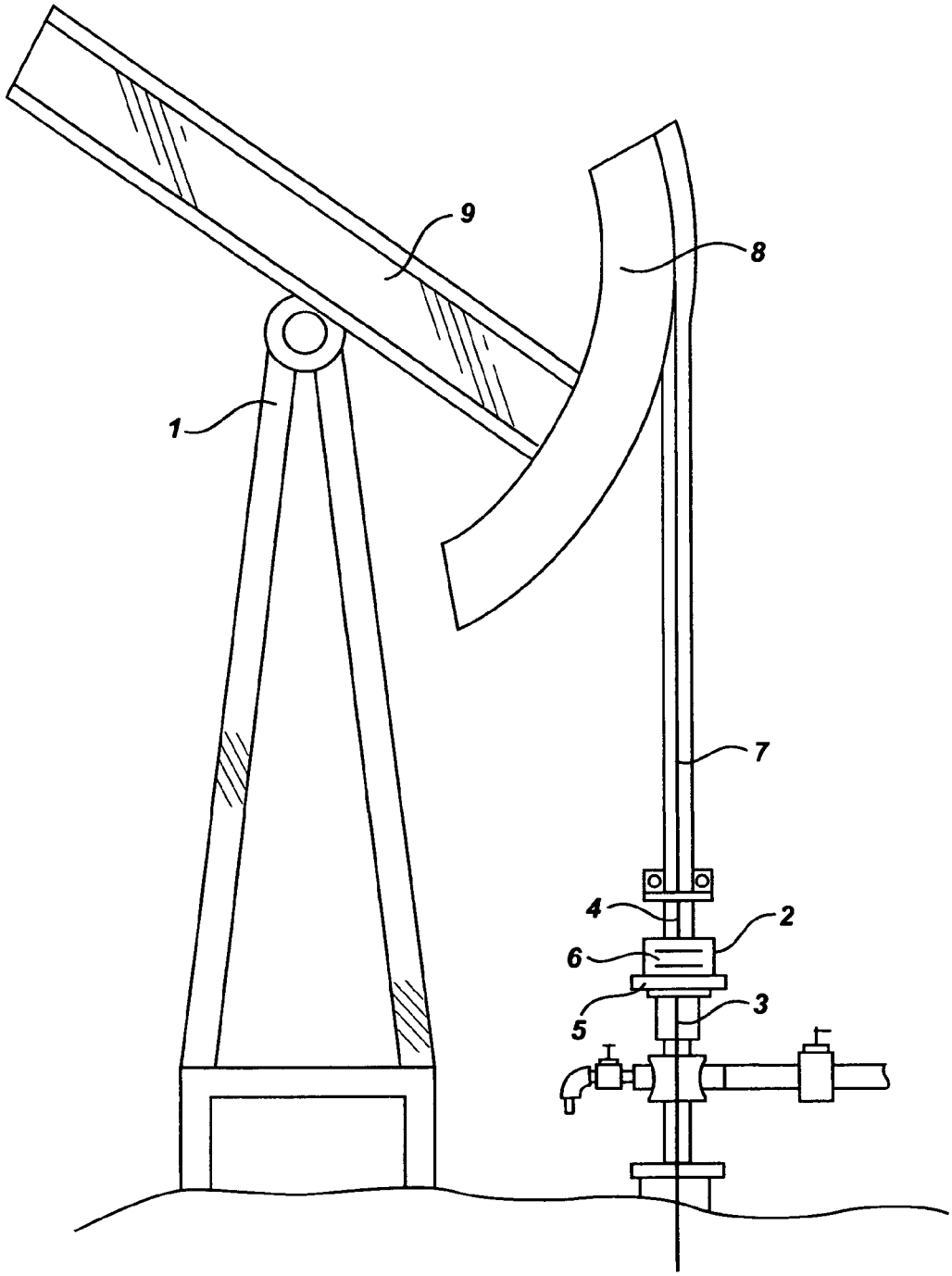
FIG. 1—drawing of the rod rotator, which is installed on the pumping unit and is in the docked position in the lower dead center.

FIG. 1 shows pumping jack unit (1) with the rod rotator (2) which is installed on wellhead stuffing box (3) and polished rod (4). Main parts (5) and (6) of the rod rotator (2) are in a docked position. Polished rod (4) is hung on a cable (7) which is installed on the head (8) of the arm (9) of the pumping jack unit (1). The pumping jack unit (1) is in the lower dead point.

Figure 2:
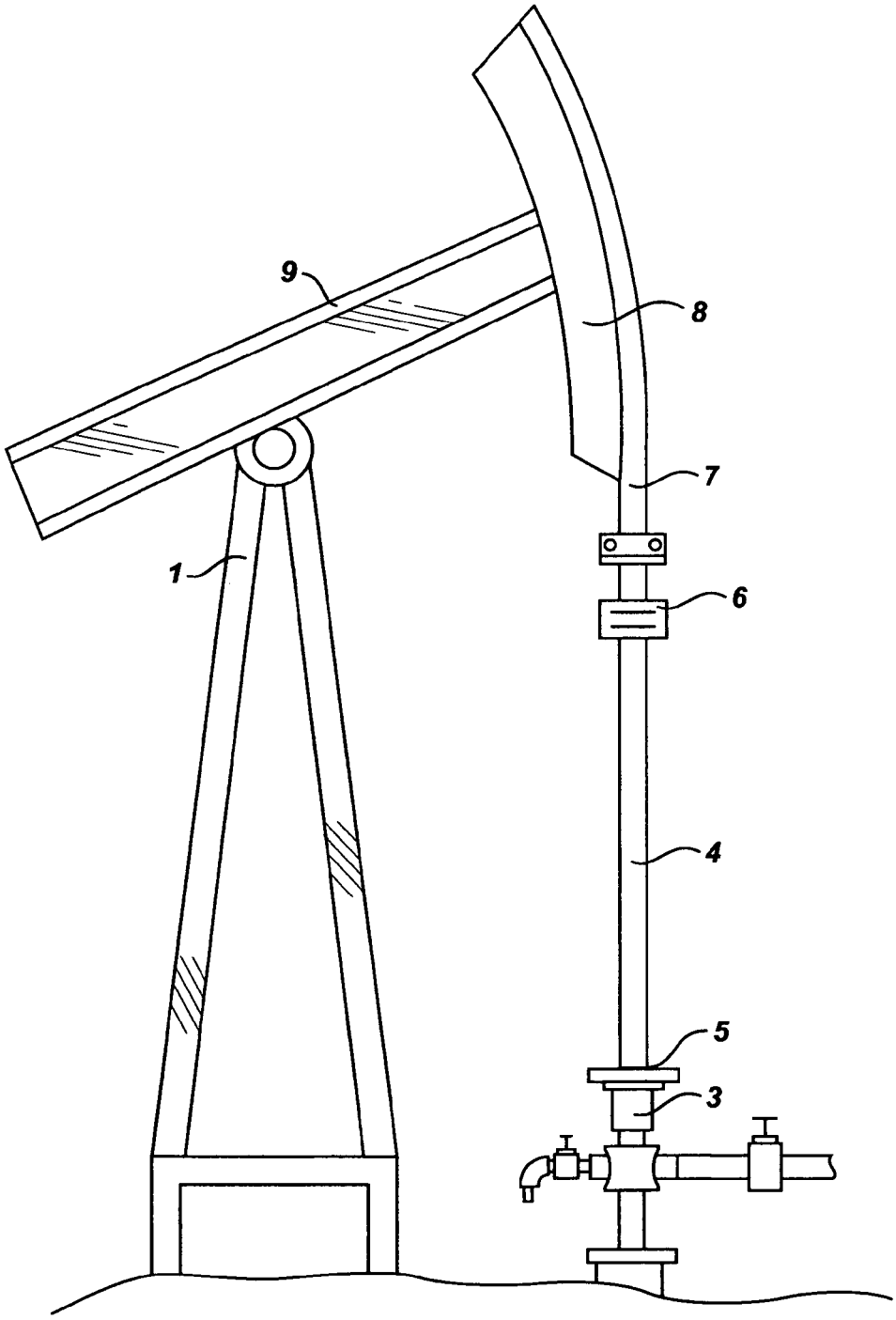
FIG. 2—drawing of the rod rotator in an undocked position going up the pumping unit.

FIG. 2 shows the position of the pumping jack unit (1) in the upper dead point where the polished rod (4) is fully out of the well. In this position the part (5) remains on the wellhead stuffing box (3), and the part (6) is lifted upwards by the polished rod (4), which demonstrates that the rod rotator is in an undocked position.

Figure 3:
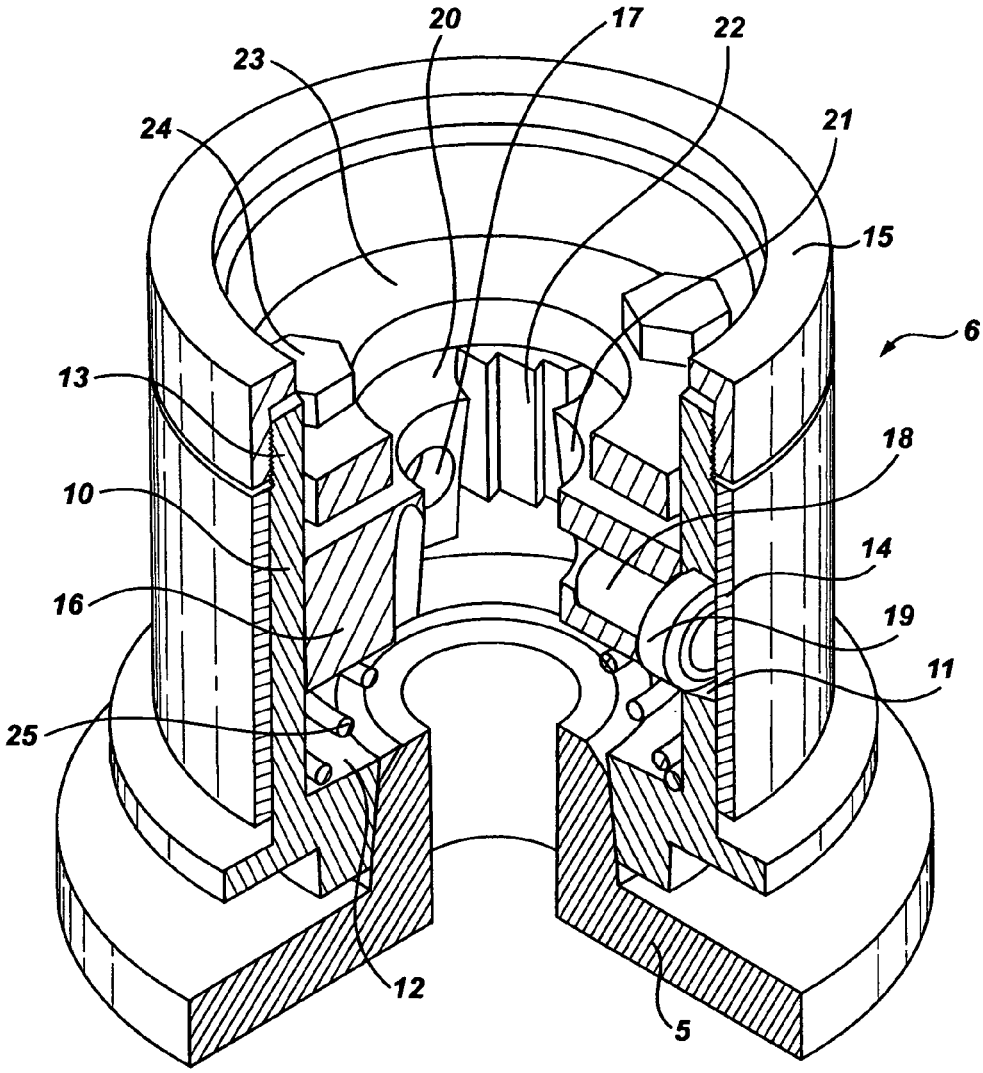
FIG. 3—general sectional view of the rod rotator in an assembled form and docked position as in FIG. 1

FIG. 3 shows the rot rotator (2) with its main parts (5) and (6). Both parts (5) and (6) are in a docked position through mutually docking surfaces (8) of the part (5) and (9) of the part (6). Both surfaces (8) and (9) are made in the shape of self-locking (or self-braking) cones. The part (6) contains a body (10) that has two spiral slots (11), bottom (12) and thread (13) on the upper end. Cover (14) is placed on the body (10) from outside, and the upper thread has a cap screw (15). The inner hollow part of the body (10) contains rotator (16). The rotator (16) has two horizontal holes (17) where axes (18) with rollers (19) are installed. Cotters (22) with teeth to grip polished rod (4) are located from the upper face plane (20) of the rotator (16) exiting through its central hole (21). Cotters (22) are placed in seats in the rotator (16) and clamped between polished rod (4) and rotator (16) with a round plate (23) and bolts (24).

Inside the body (10) there is a spring (25) between rotator (16) and bottom (12). The ends of the spring (25) butt into the rotator (16) and bottom (12) and can contract and expand when rotator (16) moves up and down.

Figure 4:
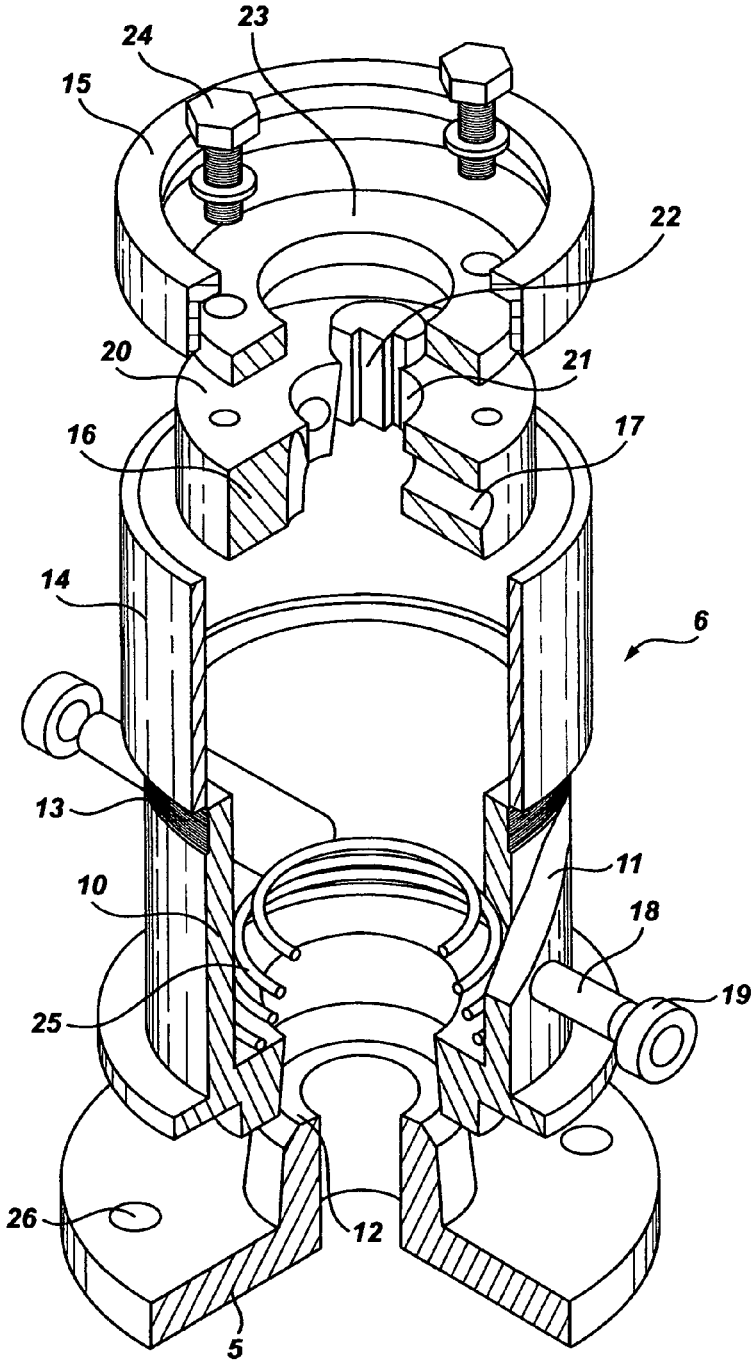
FIG. 4—sectional view of the assembly drawing of the rod rotator

FIG. 4 is the assembly drawing of rod rotator. The main part (5) has holes (26) for attaching with bolts or stud bolts to the wellhead stuffing box (3).

The present invention works as follows. When arm (9, FIG. 1) with the head (8, FIG. 1) of the pumping jack unit (1) is lowered, a cable (7) along with the part (6) of the rod rotator (2) moves to the part (5) installed on the wellhead stuffing box (3). At a calculated distance, for example 70 mm, the parts (5) and (6) dock using their docking surfaces (8, FIG. 3) and (9, FIG. 3). From this moment on, both parts (5) and (6) remain fixed with respect to each other. The movement down continues only by the rotator (16) under the weight of the entire string of sucker rods connected with polished rod (5). The weight of sucker rods forces the rotator (16) to move down using rollers (19) on spiral slots (11) rotating the polished rod (5) along with the sucker rods until the completion of the arm (9, FIG. 1)) movement in the lower dead point. In the process of the downward movement of the rotator (16) the spring (25) is pressed to the bottom (12).

The rollers (19) having reached the lower position in the spiral slots (11) complete the rotation of the sucker rods with respect to the string of oil well tubing that is located inside the oil well. The rotation angle of the string of sucker rods is determined by the angle of gradient of the spiral slots (11) and reaches several tens of degrees.

After the halt in the lower dead point the arm (9, FIG. 1) starts lifting, and the parts (5) and (6) undock at this moment as their surfaces (8, FIG. 3) and (9, FIG. 3) undock from each other. The part (5) remains down at the stuffing box (3) as it is attached to it through the holes (26), and the part (6) moves up with the polished rod (5). During the upward movement the compressed spring (25) begins to expand pushing the free end of the part (6) down and at the same time the body (10) both rotates and moves down with respect to the inactive rotator (16). The spiral slots (11) move down on rollers (19) until the rollers (19) are above the spiral slots (11).

When the head (8, FIG. 1) moves further up, the rod rotator stays static waiting for the completion of the oscillation cycle of the pumping unit (1). Then the new cycle repeats the above-described process.

The fabrication and testing of the sample of the present invention proved its advantages over other existing technologies mentioned above.

The results of these tests in specific figures are below in the comparison table.

The analysis of the data given in the table demonstrates that the invention achieved advantages in performance several fold. At the same time the weight of the rod rotator was decreased.

COMPARISON TABLE

| SPECIFICATION | "R&M ENERGY SISTEM" COMPANY T-252 type | T-302 type | RODEC RODEC rod rotator | Present Invention Present Invention |
|---|---|---|---|---|
| MAX. OUTPUT TORQUE, ft/lbs (kGm) | 120 (15.6) | 240 (32.4) | DATA NOT AVAILABLE | 740 (100) |
| MAX. RECOMMENDED LOAD, lbs | 33.000 | 40.000 | 40.000 | One type on all depths (up to 100.000) |
| REQUIRED OPENING BITWEEN BRIDLE LINES | 4" | 7" | 7" | NOT APPLICABLE |
| POLISHED ROD SIZES | 1⅛-1½ | 1⅛-1¼ | 1⅛-1¾ | 1⅛-1½ |
| HEIGHT | 5½ | 6½ | 4¼ | 4¼ |
| ROTATOR TYPE | Ratchet | Helical gear | Helical gear | Spiral |
| BODY MATERIAL | Ductile iron | Ductile iron | Ductile iron | Ductile iron |
| ACTUATOR CABLE | 16' | 25' | Data not available | NOT APPLICABLE |
| SHIPING WEIGHT (Lbs) | 35 | 47-62 | 55 | 30 |
| ANGLE OF TURN OF A ROD ONE PUMPING, Degree/Stroke | 15/24 | 4.67/77 | 2.25/166 | 30-40 and more/12-8 and less |

The invention claimed is:

1. A rod rotator comprising of two parts, a) a base plate attached to a well-head stuffing box and b) an upper assembly attached to a polished rod, both parts having docking surfaces for periodic docking and undocking; wherein the upper assembly comprises: a body with a plurality of spiral slots in the interior that contain rotatable rollers; wherein the body is hollow and contains a rod rotator with horizontal holes, wherein the rollers engage in the spiral slots; wherein the connection between the upper assembly and the polished rod is made of toothed cotters that are clamped by a bolted plate between the polished rod and the rotator allowing the rotator to move up and down inside the hollow body; a cap screw in the hollow body that screws onto a threaded part of the upper end of the body; and a bottom with a central hole and a spring which is located between the bottom and the rotator.

2. The rod rotator of claim 1 wherein both parts, the base plate and upper assembly, have docking surfaces which allow for fixed docking of both parts where this type of docking is accomplished by making two conical surfaces with self-braking angles.

* * * * *